United States Patent [19]

Balaz

[11] Patent Number: 4,778,179

[45] Date of Patent: Oct. 18, 1988

[54] RACKET COVER

[76] Inventor: Sandor Balaz, Majorsallén 5, S-531 33 Lidköping, Sweden

[21] Appl. No.: 15,127

[22] PCT Filed: May 30, 1986

[86] PCT No.: PCT/SE86/00254

§ 371 Date: Jan. 27, 1987

§ 102(e) Date: Jan. 27, 1987

[87] PCT Pub. No.: WO86/06972

PCT Pub. Date: Dec. 4, 1986

[30] Foreign Application Priority Data

May 30, 1985 [SE] Sweden ..... 8502656

[51] Int. Cl.[4] ..... A63B 49/18

[52] U.S. Cl. ..... 273/76; 273/74; 150/52 G; 206/315.1; 224/919

[58] Field of Search ..... 273/76, 74, 67 R, 73 R; 150/52 A, 52 G; 206/315.1, 315.9, 1.5; 220/346, 347; 224/242, 919

[56] References Cited

U.S. PATENT DOCUMENTS

| | | | |
|---|---|---|---|
| 1,509,689 | 9/1924 | Reach | 273/74 |
| 2,926,912 | 3/1960 | Gould | 273/74 |
| 3,604,706 | 9/1971 | Bankney | 273/DIG. 12 |
| 4,052,062 | 10/1977 | Casavant | 273/74 |

FOREIGN PATENT DOCUMENTS

| | | | |
|---|---|---|---|
| 2421865 | 12/1974 | Fed. Rep. of Germany | 206/315.1 |
| 2642085 | 9/1976 | Fed. Rep. of Germany | 273/74 |
| 3324199 | 1/1985 | Fed. Rep. of Germany | 206/315.1 |
| 1586713 | 3/1981 | United Kingdom | 273/74 |

*Primary Examiner*—Richard C. Pinkham
*Assistant Examiner*—Jessica J. Harrison

[57] ABSTRACT

A cover for rackets, such as table tennis rackets having an impact portion and a handle portion, comprises a casing having two connected plate-shaped members forming an inner space therebetween for insertion of a racket. An opening is provided in the casing as access to the inner space. The casing has a stop to position the racket in the inner space. Each of the plate-shaped members has holes facing each other into which a ball can be inserted after the racket is placed into the casing to lock the racket in the inner space. The ball is removable from the holes to free the racket and allow its removal from the casing.

6 Claims, 2 Drawing Sheets

RACKET COVER

TECHNICAL FIELD

The present invention relates to a cover for rackets, such as table tennis rackets, displaying an impact portion 13 and handle 14, such cover comprising a casing 1 with an inner space 16 adapted and intended to accommodate the racket.

BACKGROUND

It is currently customary in different types of racket sports to protect the rackets against external influences such as wetness and abrasion. To this end covers are used, preferably of two types, namely, soft or hard. The soft cover is preferably sewn to follow the impact surface of the racket while the hard cover is of a rectangular shape and is often constructed of some type of wood material. The soft cover does not give sufficient protection against bumps and blows while the hard cover quickly becomes worn and increases the wear and tear on the racket.

The purpose of the present invention is to provide a racket cover which provides satisfactory protection, has simple construction, is cheap to produce and is easy to handle.

THE SOLUTION

Said purpose is achieved by means of a cover characterized in that the casing is generally constructed of two connected plate-shaped members positioned at a distance from each other, in that the casing exhibits an opening into which the racket is intended to be inserted to a position which is determined by stopping means in the casing, in that each of the plate shaped elements exhibits holes placed directly in front of each other and into which holes a ball is intended to be placed after the racket is inserted into the casing, in that the holes are placed outside of that portion of the plateshaped members which is located directly adjacent to the impact portion of the racket when in its inserted position, in that the holes are arranged so as to hold the balls in such a position that they span the space between the plate-shaped members, and in that stopping means are provided in the casing to, in cooperation with the balls, by stopping sections of the racket, secure the racket in the inserted position in the casing.

BRIEF DESCRIPTION OF THE DRAWINGS

In the following the invention will be described in more detail using a working example with reference to the accompanying drawings in which.

Figure 1:
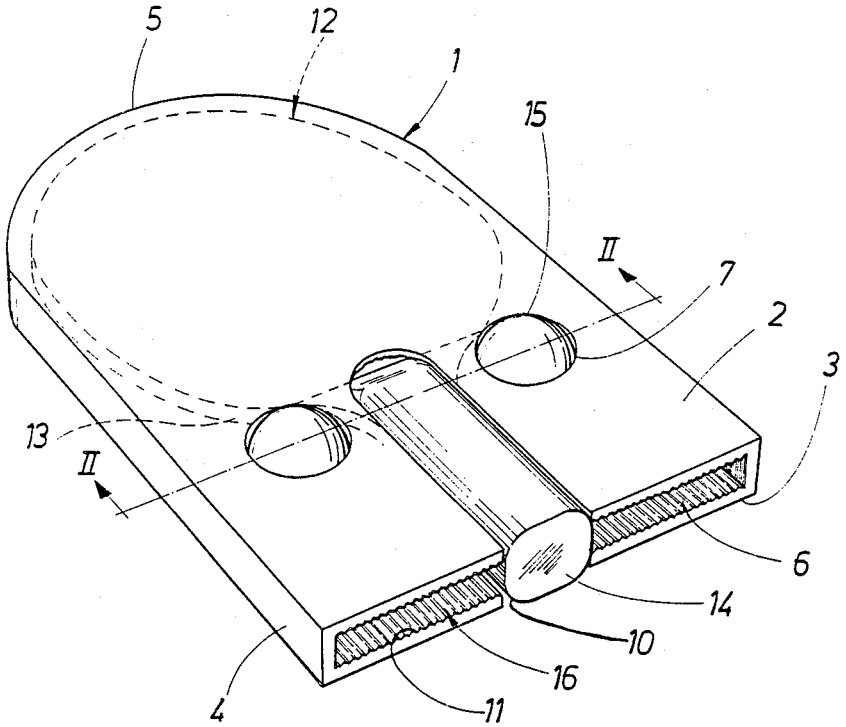
FIG. 1 shows a perspective view of the racket cover.
Figure 2:
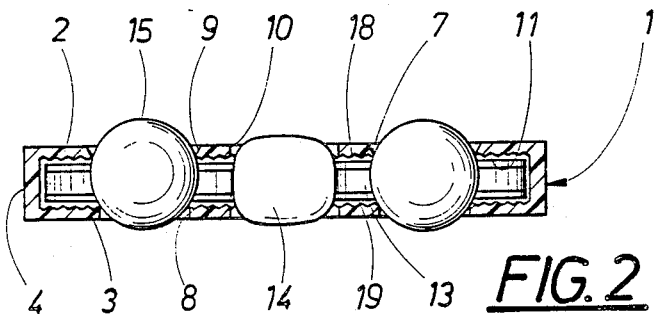
FIG. 2 shows a section along the line II—II in FIG. 1
Figure 3:
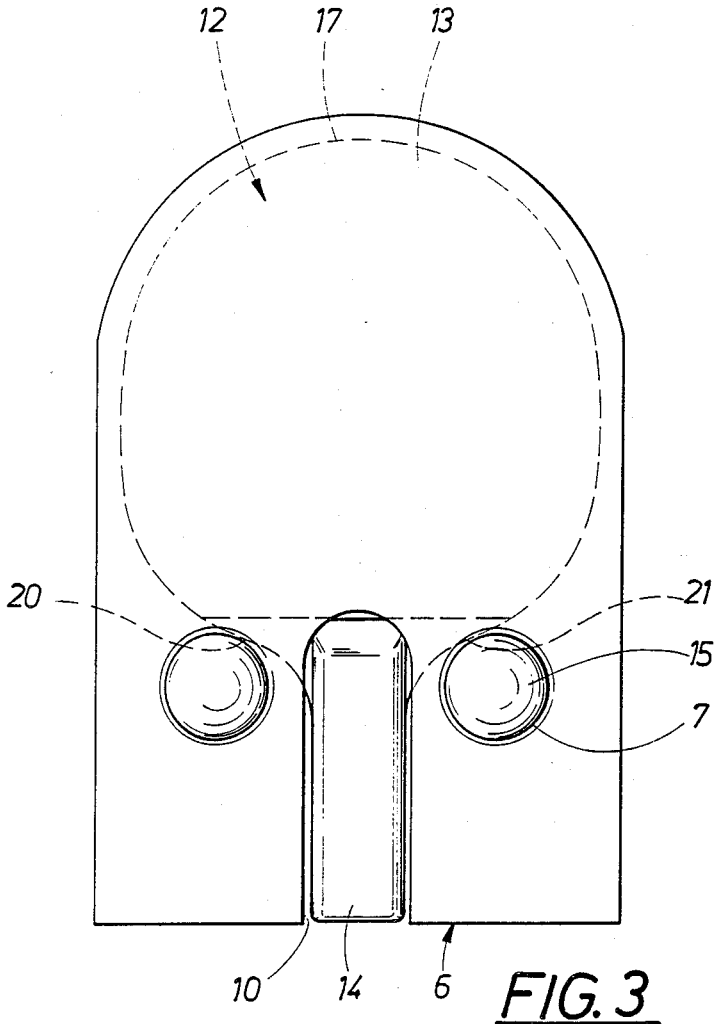
FIG. 3 shows a view of the racket cover from above.

BEST MODE OF CARRYING OUT THE INVENTION:

As is shown in FIGS. 1 to 3, the cover consists mainly of a casing 1 having rectangular cross section, manufactured preferably of some type of plastic material and having a casing which exhibits two hard plate-shaped members 2 and 3 located at a distance from one another, which are held at a determined distance from one another by means of separating means 4 such as a whole wall extending along the edge portions of the plate-shaped members as in the given example or as freely standing separating means, such as tube members, applied with even spacing along the edge portions of the plate-shaped members. The casing further exhibits a generally semicircularly shaped end 5 and an opposite, straight, open end 6. Each of the plate members 2 and 3 is preferably provided with two circular holes, first holes 7 in plate member 2 and second holes 8 in plate member 3, placed pairwise directly across from each other at a distance from the outer edges of the plate-shaped members, such that the diameters of the second holes 8 are preferably smaller than the diameters of the first holes 7, the first holes 7 each having an outwardly facing bevel 9. Each of the plate-shaped members 2 and 3 further has a longish notch 10, extending from the open end 6 towards and between the holes 7 and 8. The plate-shaped members' insides, which face each other, have parallel grooves which extend between the open end 6 and the arc-shaped end 5.

The casing 1 is arranged to enclose a racket 12, preferably a table tennis racket, whereby its circularly shaped impact portion 13 contacts the semicircularly shaped end 5 between the separating means 4 within the edge portions of the plate-shaped members. The distance between the plate-shaped members 2 and 3 is sufficiently great that the thickness of the impact portion 13 of all rackets currently available on the market can be enclosed by the casing 1 between the plate members. The racket 12 further has a rod-shaped handle portion 14 which, in the inserted position of the racket in the cover, is positioned between the plate-shaped members 2 and 3 and the notches 10, whereby the somewhat convex surfaces of the handle stick up to a certain extent out of the notches over the surfaces of the plate members, and the edge portions of the notch contact the handle to a certain extent so that it is secured laterally. Detachable, spherical and partially resilient locking means, preferably two of the playing balls 15, which are used in the racket sport in question, in this case, table tennis balls, are placed in the holes 7 and 8 on the plate-shaped members, whereby the diameters of the balls only slightly exceed the diameters of the first holes 7, so that the balls, with their great circles considered parallel to the plate elements 2 and 3, lie between the plate elements at a level below the first holes 7.

Upon insertion of the racket 12 into the casing 1 the balls 15 are removed from the holes 7 and 8 whereupon a free, open spaces 16 is created in the casing, bounded by the plate elements 2 and 3 and the separating means 4, so that the racket can be inserted between the plate elements with the front edge portions 17 of the impact portion facing the open end 6, whereby a certain clearance between the impact surfaces 18 and 19 of the impact portion 13 and the plate elements facilitates insertion of the racket. Insertion is further facilitated by means of the grooves 11 on the insides of the plate elements 2 and 3, which lessen the friction between the impact surfaces and the plate elements when the racket is inserted into the casing. This is especially important since the impact surfaces 18 and 19 are often covered with a rubber material, which tends to stick to and, because of suction, to adhere to flat surfaces, especially plastic surfaces. The grooves are preferably produced by means of milling or mounding, whereby the surface lying between the grooves forms a contact surface for the impact surfaces.

The racket 12 is inserted in the direction towards the arc-shaped end 5 in such a way that the handles 14 of the racket are guided towards the notches 10 in the plate elements 2 and 3 and are inserted in the notches, whereby the length of the notches is adapted to the length of the handle so that the entire racket 12 fits in the casing and is protected by its outer edges. The front edge portion 17 of the impact portion 13 contacts the inside of the wall 4 at the arc-shaped end 5 as shown in FIGS. 1 and 3. The handle 14 then lies between the plate elements 2 and 3 and contacts the edge portions of the notch 10 so that the handle, because its surfaces are convex and jut out somewhat from the notches above the surfaces of the plate elements, is easily grasped upon insertion and removal of the racket. In this manner the racket is transversely secured, partly by means of the position of the impact portion 13 between the wall 4, and partly by means of the position of the handle 14 in the notch 10. Furthermore, the position of the racket in the longitudinal direction in the casing is secured by the balls 15 being placed in the holes 7 and 8 after the racket has been inserted into the casing. The holes in the plate elements are provided at a position directly outside of the rear edge portions 20 and 21 of the impact portion 13 adjoining the place of attachment of the handle 14 to the impact portion on either side of the handle as is shown in FIG. 3, in such a way that some separation is provided between the position of the holes and the position of the edge portions of the impact surface in order to attain optimal adaptability to different models of rackets, the length of the impact portion of which varies.

When the balls 15 are introduced into the first holes 7, the bevels 9 provide some control of the ball in the holes and facilitate the compression of the ball which arises due to the diameter of the ball being somewhat larger than the diameter of the hole, so that there is some resistance to the compression. Because the hole has a smaller diameter than the ball, some snapping action will arise when the ball is inserted into the hole, so that the ball will pop out of the hole between the plate elements 2 and 3 toward the other hole 8, the diameter of which is less than that of the first hole 7 and considerably less than the diameter of the ball, so that the ball cannot pass through the second hole 8 but rather remains in a position between the plate elements 2 and 3 with its great circle, which is parallel to the plate elements, located between the plate elements, which, because of the contact of the rear edge portions 20 and 21 with the balls, prevent removal of the racket from the casing. The separation which is provided between the balls and the edge portions of the impact surface can be reduced, for example, by providing a resilient member between the impact portion's front edge portion 17 and the wall 4 at the arc-shaped end 5 so that the impact portion is pressed against the spherical surface of the balls 15. Because the diameter of the balls is greater than the diameter of the first hole 7, the balls are held in position between the plate elements 2 and 3 even when not pressed by the impact surface, so that, in order to remove the balls, force is required to overcome the resistance of the balls to being pressed through the first hole 7. Because of this it is therefore necessary that the balls be accessible from the outside of one plate element, which is made possible by the other holes 8, for pressing the balls out of the first holes 7, whereupon the racket, by gripping the handle 14, can be removed from the casing through the open end 6.

The invention is not limited to the working example which has been described above and illustrated in the drawings but can be varied within the framework of the following claims. For example, in order to lock the racket in the casing it is only necessary to have one ball placed in one hole. It is not necessary to utilize grooves in order to lessen friction but rather, for example, tightly packed bristles or a securely glued felt material can be used. Neither is it necessary for the casing to have a semicircular end but, rather, the casing could have a completely rectangular shape. Furthermore, the casing can be provided with a carrying handle or a surrounding, soft, outer cover. The stopping function of the balls has been mentioned above. The ability to place two balls in the casing also creates a storage place for these balls, which are easily accessible to the player during, for example, training sessions. The notches 10 for the handle 14 can be replaced by two suitably shaped raised portions formed in the plate-shaped elements 10.

I claim:

1. A cover ball for game rackets having an impact portion and a handle portion, the cover comprising a casing with an inner space, the casing comprising two interconnected plate shaped members positioned at a distance from each other forming said inner space therebetween, an opening in said casing for the insertion of a racket into the inner space, said opening being formed between first edge portions of said plate-shaped members, fixed stopping means positioned along second edge portions of said plate-shaped members for the purpose of positioning the racket within said inner space upon insertion of the racket therein, and locking means for locking the racket in the inner space of said casing, said locking means comprising at least one pair of holes in the plate-shaped members facing each other and at least one removable game ball insertable through at least one hole of said at least one pair of holes, and securable in a locking position in said at least one pair of holes and spanning said inner space, locking the racket within the casing, said at least one game ball being removable from its secured position for the purpose of releasing the racket and freeing same to be removed from said inner space through said opening in said casing.

2. A cover according to claim 1, wherein one hole of said at least one pair of holes has a bevel, and the diameter of said one hole is greater than that of the other hole of said at least one pair of holes and less than the diameter of said at least one game ball.

3. A cover according to claim 2, wherein said at least one game ball is partially compliant and can be positioned between the plate-shaped members in said at least one pair of holes and held in this position by the diameter of said ball being greater than the diameter of the holes.

4. A cover according to any one of claims 1 to 3, wherein said locking means comprise two pairs of holes and two game balls.

5. A cover according to claim 1, wherein the plate-shaped members have a number of parallel grooves in inner sides thereof, said grooves being aligned in a direction from the opening inwardly in the inner space in the casing.

6. A cover according to claim 1, wherein the plate-shaped members each have a longitudinally extending notch through which a handle portion of a racket can jut out when the racket is inserted into said inner space.

* * * * *